US006305918B2

(12) United States Patent
Turiansky

(10) Patent No.: US 6,305,918 B2
(45) Date of Patent: Oct. 23, 2001

(54) PISTON ROD SEAL ASSEMBLY FOR WALKING BEAM COMPRESSOR

(75) Inventor: Basil Turiansky, Denver, CO (US)

(73) Assignee: Basil International, Inc., Denver, CO (US)

( * ) Notice: Subject to any disclaimer, the term of this patent is extended or adjusted under 35 U.S.C. 154(b) by 0 days.

(21) Appl. No.: 09/728,753

(22) Filed: Dec. 4, 2000

Related U.S. Application Data

(62) Division of application No. 09/132,697, filed on Aug. 11, 1998, now Pat. No. 6,164,935.
(60) Provisional application No. 60/061,184, filed on Oct. 3, 1997.

(51) Int. Cl.[7] ..... F04B 39/10; F04B 53/10
(52) U.S. Cl. ..... 417/534
(58) Field of Search ..... 417/534, 521, 417/437; 92/165 R; 271/300, 301, 305, 309, 320

(56) References Cited

U.S. PATENT DOCUMENTS

| | | | |
|---|---|---|---|
| 1,775,733 | 9/1930 | Phipps . | |
| 2,049,315 | 7/1936 | Patterson | 267/1 |
| 3,655,301 | 4/1972 | McClung | 417/437 |
| 4,189,157 | 2/1980 | Mahan et al. | 277/3 |
| 4,345,734 | 8/1982 | Studinger | 248/669 |
| 4,466,335 | 8/1984 | Milburn et al. | 91/173 |
| 4,530,646 | 7/1985 | McCoy | 417/464 |
| 4,536,134 | 8/1985 | Huiber | 417/360 |
| 4,557,351 | 12/1985 | Volk | 184/18 |
| 4,917,190 | 4/1990 | Coppedge | 166/379 |
| 5,165,699 | 11/1992 | Shrontz et al. | 277/1 |
| 5,209,495 | 5/1993 | Palmour | 277/3 |
| 5,290,156 | 3/1994 | Mayland | 417/415 |
| 5,628,516 | 5/1997 | Grenke | 277/1 |
| 5,711,533 | 1/1998 | Angelo et al. | 277/105 |
| 5,845,909 | 12/1998 | Angelo et al. | 277/308 |
| 5,906,354 | 5/1999 | Gilbert et al. | 251/214 |
| 5,975,538 | 11/1999 | Krause et al. | 277/551 |
| 6,012,903 | 1/2000 | Boelkins | 417/63 |
| 6,164,935 * | 12/2000 | Turiansky | 417/534 |

FOREIGN PATENT DOCUMENTS

| | | |
|---|---|---|
| 56164244 | 12/1981 | (EP) . |
| 2149462 | 6/1985 | (GB) . |

OTHER PUBLICATIONS

Catco Energy Systems, Inc., "Catco Walking Beam Gas Compressor" 1pp. brochure, 1995.
GCE Gas Compression & Engineering, Inc., "Vacu–Pres Vacuum & Pressure" brochure, 15 pps.

* cited by examiner

*Primary Examiner*—Teresa Walberg
*Assistant Examiner*—Daniel Robinson
(74) *Attorney, Agent, or Firm*—Sheridan Ross P.C.; Brent P. Johnson, Esq.

(57) ABSTRACT

A walking beam compressor has a rod collar assembly attached to the top cap of the compressor cylinder with bearings which reduce side loading on the seals and bearing surfaces in the top cap. A top cap assembly supports a pair of vertically stacked seals sandwiched between three inserts. Upper and lower inserts each house a wear ring so that the respective wear rings are above and below the seals. The piston is divided into an upper section and a lower section to facilitate the mounting of a peripheral seal at the mating surfaces of these sections. The peripheral edge of each section has a recess for receiving a wear ring. A structure is provided to facilitate separating the upper and lower sections during disassembly.

3 Claims, 3 Drawing Sheets

156
156
65
82
84
86
78
85
70
70
68
66
54
64
72
76
80
74
24
56
90
126
128
108
C
128
118
58
62
60
62
112
52
46
106
48
102
94
48
36
134
159
130
148
138
158
156
140
150
48
139
136
48
146
143
144
132
152
160
154
160
142
50
50
32
34

PISTON ROD SEAL ASSEMBLY FOR WALKING BEAM COMPRESSOR

This application is a division of parent application Ser. No. 09/132,697 filed on Aug. 11, 1998 now U.S. Pat. No. 6,164,935.

This application claims benefit of provisional application No. 60/061,184, filed Oct. 3, 1997.

TECHNICAL FIELD

This invention relates to a walking beam compressor, and more particularly to a walking beam compressor which has a rod collar assembly to minimize wear of the compressor rod seals. The compressor also has an improved piston rod seal assembly and an improved piston assembly.

BACKGROUND ART

Typically, a pumping unit for an oil well includes a compressor mounted between the walking beam and the Samson post or other stationary part of the pumping unit. A chronic problem associated with walking beam compressors is that rod side loading often occurs which results in excessive wear of the rod seals in the rod seal assembly of the compressor which engage the piston rod as it moves up and down. Various attempts have been made to overcome the problems associated with side loading. For example, Mayland U.S. Pat. No. 5,290,156 discloses the use of spherical bearings at each of the connecting ends of the compressor to allow universal movement in response to any lateral displacement or side loading. Studinger U.S. Pat. No. 4,345,744 uses spherical bearings at each of the connecting ends of the compressor to allow non-restricted, omni-directional movement at both connecting ends. McCoy U.S. Pat. No. 4,530,646 has a swivel connector at opposite ends for connecting the compressor to the walking beam and the Samson post to accommodate side loading. McClung U.S. Pat. No. 3,655,301 has knuckle joints and a buckle adjuster to minimize side loading. While these devices are satisfactory for their intended purpose, no attempt has been made to modify the compressor structure to minimize side loads thereon.

DISCLOSURE OF THE INVENTION

The present invention is directed to a walking beam compressor having a rod collar assembly attached to the top cap of the compressor cylinder and has bearings which absorb side loading imposed on the piston rod. The rod collar assembly includes a sleeve which extends upwardly from the top cap and supports a pair of stacked inserts which form a recess to support a bearing through which the piston rod extends.

Conveniently, the top cap includes a top cap assembly which supports a pair of vertically stacked seals sandwiched between three inserts. The inserts are housed in a counterbore formed in the top cap and covered by an insert cap thereabove. Each of the upper and lower inserts houses a wear ring so that one wear ring is above the seals and the other wear ring is below the seals.

The piston is divided into an upper section and a lower section to facilitate the mounting of a peripheral seal at the mating surfaces of these sections. The peripheral edge of each section has a recess for receiving a wear ring. A structure is provided to facilitate separating the upper and lower sections during disassembly.

Additional advantages of this invention will become apparent from the description which follows, taken in conjunction with the accompanying drawings.

BEST MODE FOR CARRYING OUT THE INVENTION

Figure 1:
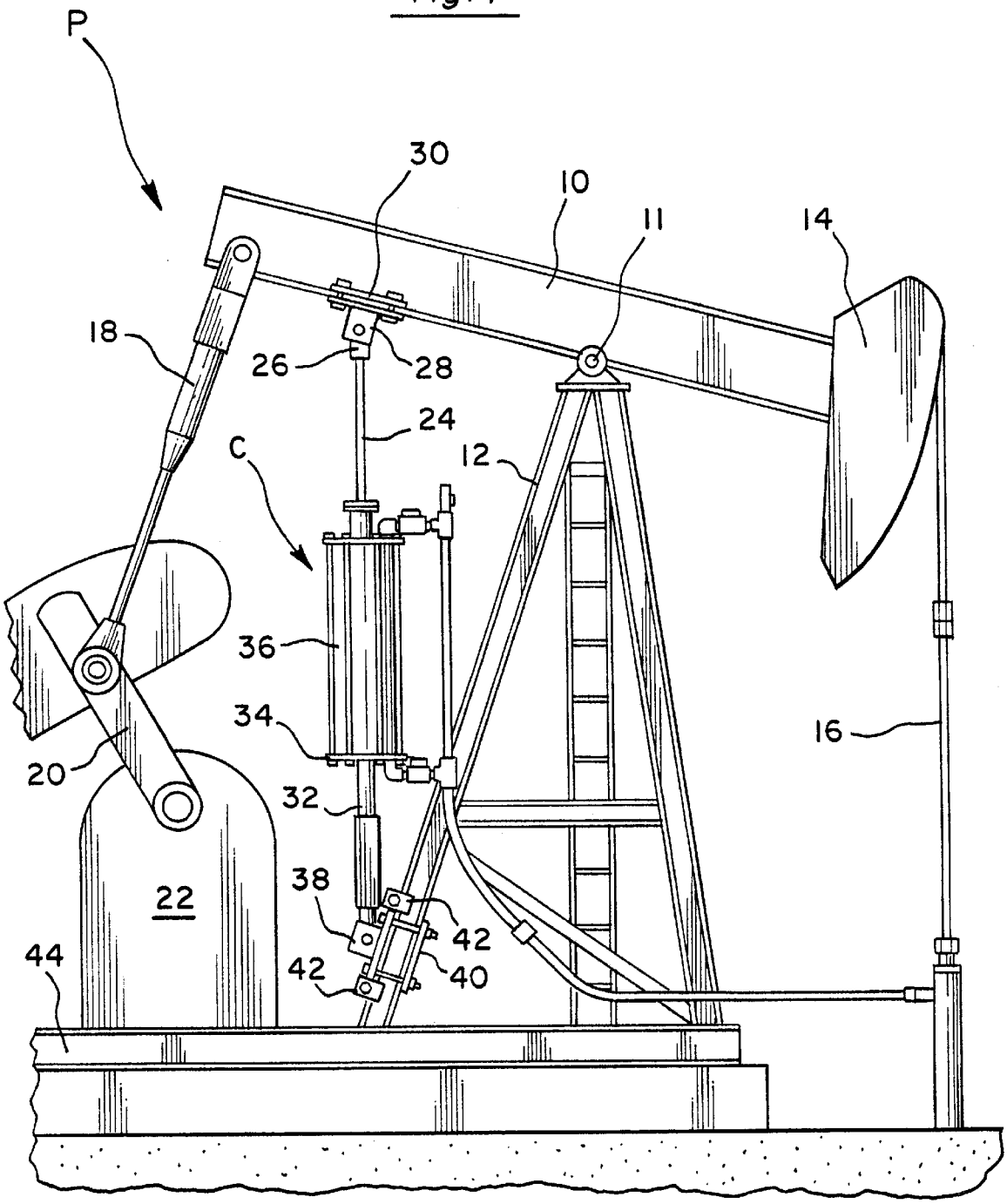
FIG. 1 is a fragmentary side elevation of an oil well pump incorporating the novel compressor of this invention.

In accordance with this invention, an oil well pump P, as shown in FIG. 1, includes a walking beam 10 pivotally mounted by bearing 11 on the top of Samson post 12. A horsehead 14 on one end of walking beam 10 is connected to rod 16 for operating a downhole pumping system as is well understood in the oil production industry. A connecting rod 18 is connected through linkage 20 to gear box 22 which drives pump P. Compressor C has a piston rod 24 attached at its upper end to coupling 26 which is pivotally mounted in bracket 28 attached to walking beam 10 by bracket 30. Compressor C has a lower support leg 32 whose upper end is connected to lower cover plate 34 of cylinder 36 and whose lower end is pivotally connected to a bracket 38 attached to a leg of Samson post 12 by a clamp 40. Additional clamps 42 may be provided at each end of clamp 40, as shown, to minimize possible movement of clamp 40 along the leg of Samson post 12 during the pumping operation. Although the lower end of compressor C is shown as being attached to a leg of Samson post 12, it will be understood that it may be attached to base 44, if desired.

Figure 2:
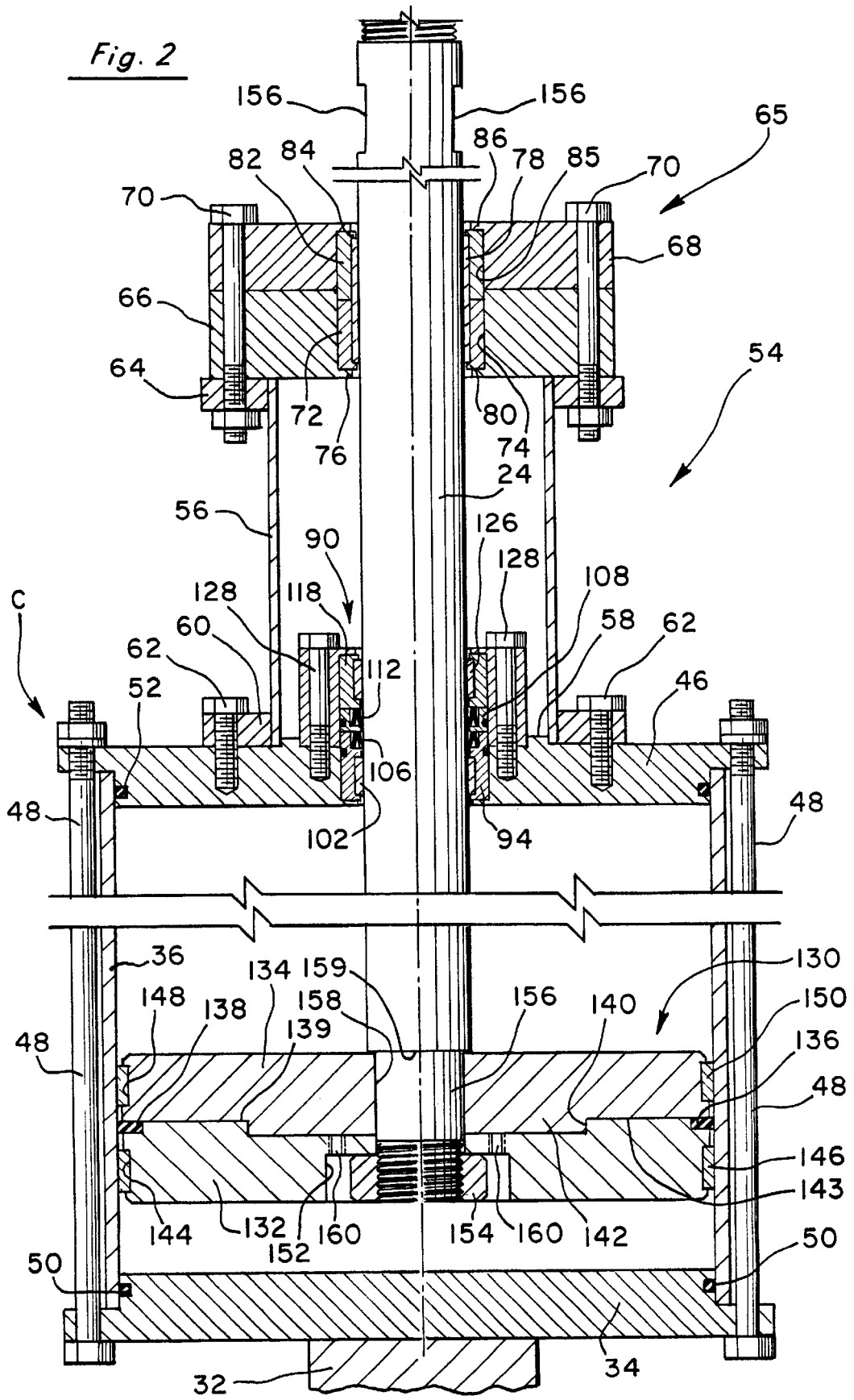
FIG. 2 is a greatly enlarged fragmentary vertical section of the compressor of FIG. 1.
Figure 3:
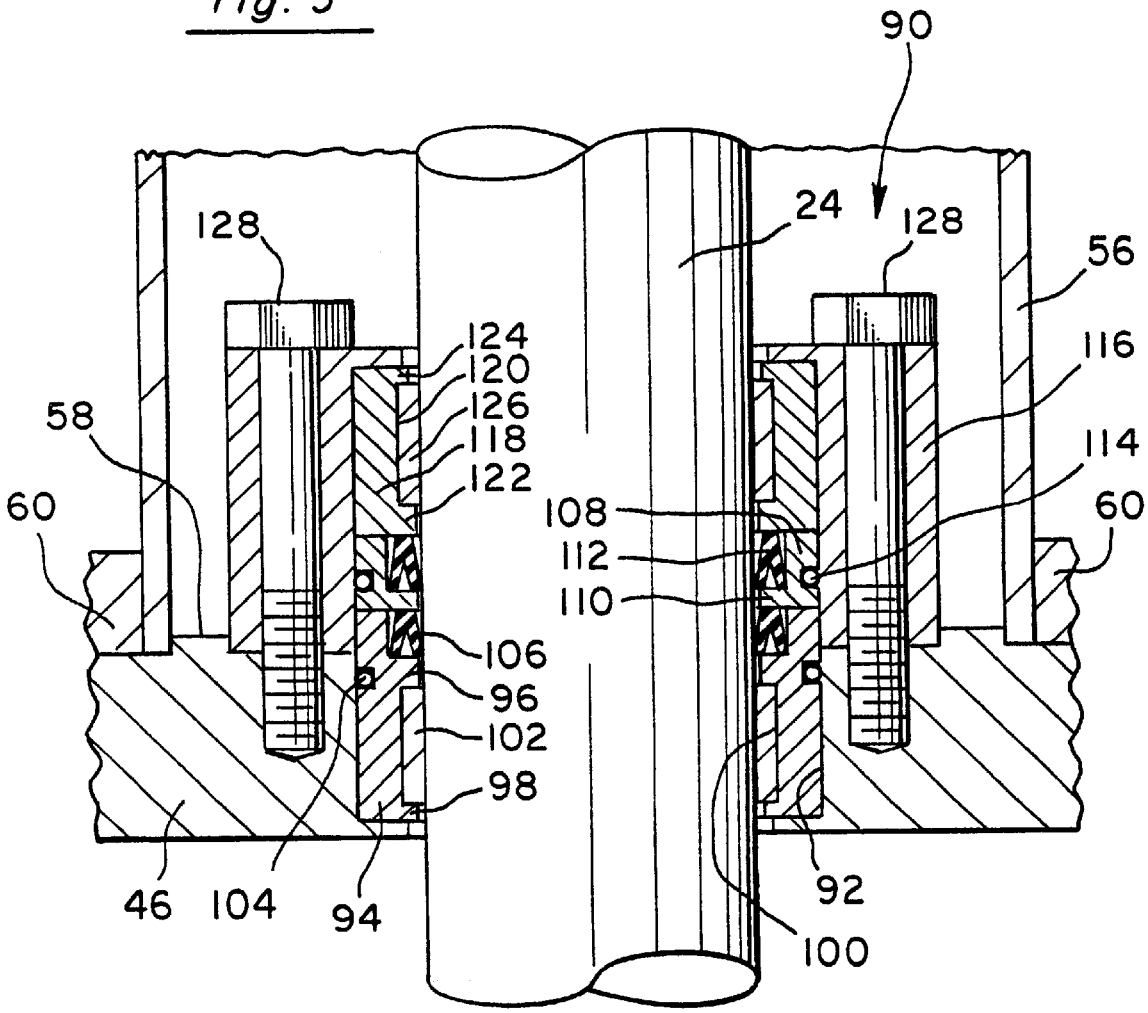
FIG. 3 is a still further enlarged fragmentary vertical section showing further details of the piston rod seal assembly.

The details of the compressor C are best understood with reference to FIGS. 2 and 3. In addition to a lower cover plate 34, cylinder 36 has an upper cover plate or cap 46. These three parts are held together by a plurality of bolts 48 spaced about the periphery of cylinder 36, extending through the peripheral flanges of lower cover plate 34 and upper cover plate 46, as shown. Advantageously, lower cover plate 34 has a peripheral recess for receiving an O-ring 50 to form a fluid-tight seal with the inner surface of cylinder 36. Similarly, top cap 46 has a peripheral groove for receiving an O-ring 52 which also forms a fluid-tight seal with the inner peripheral surface of cylinder 36.

A rod collar assembly 54 is concentrically mounted on the upper surface of top cap and includes a cylindrical sleeve 56 which is sized to fit around a circular crown 58 which extends above the top surface of top cap 46. Sleeve 56 has a lower peripheral flange 60 attached thereto, as by welding. A plurality of circumferentially spaced bolts 62 extend through lower flange 60 to connect the collar assembly 54 to top cap 46. An upper peripheral flange 64 is attached, as by welding, to the upper end of sleeve 56. Upper peripheral flange 64 supports a bearing assembly 65 having a pair of mounting rings 66 and 68, one above the other, which are held in place by peripherally spaced bolts 70 extending through the mounting rings 66 and 68 and upper flange 64, as show. Advantageously, mounting ring 66 is thicker than mounting ring 68 to facilitate assembly which will be apparent from the description to follow.

During assembly of the upper portion of rod collar assembly 54, first lower mounting ring 66 is slid down over piston rod 24 so that it is positioned on flange 64. Next, arcuate lower bearing insert 72 is placed in a first central bore 74 of lower mounting ring 66 so that it rests upon rim 76, as shown. Next, annular bearing 78 is slid down over piston rod 24 and into the space between the inner surface of arcuate lower bearing insert 72 and the outer surface of piston rod 24 so that the lower end of annular bearing 78 rests on inwardly projecting flange 80 at the lower end of arcuate bearing insert 72. Next, arcuate upper bearing insert 82 is dropped down around the upper end of annular bearing 78 so that its upper peripheral flange 84 engages the top edge of annular bearing 78. Since the upper edge of lower mounting ring 66 extends above the upper edge of arcuate bearing insert 72, an annular recess is provided to receive the lower end of arcuate upper bearing insert 82 so that it is supported between lower mounting ring 66 and bearing 78. Finally, upper bearing ring 68 is placed over upper bearing insert 82 so that a second central bore 85 thereof slides over annular bearing insert 82 and rim 86 engages the upper edge of bearing insert 82 to hold it in place. Bolts 70 hold the entire bearing assembly together as previously described. It will the apparent that with the structure just described, bearing 78 will absorb lateral or side forces imposed by piston rod 24 thereby reducing wear on the seals within piston rod assembly 90 on top cap 46.

The piston rod seal assembly 90 is best seen in FIG. 3. Top cap 46 has a cylindrical cavity 92 which receives an annular lower insert 94. Annular lower insert 94 has an upper flange 96 and a lower shorter flange 98 forming a peripheral recess 100 for holding lower wear ring 102. Conveniently, lower wear ring 102 is in the form of a split ring so that it can slide into place over lower flange 98. A first lower O-ring 104 is received in an outer peripheral groove of annular lower insert 94 to provide a fluid seal between annular lower insert 94 and the surface of bore 92. An A-shaped annular lower seal 106 rests upon upper flange 96 so that the inner leg thereof engages piston rod 24 to provide a fluid seal.

An annular center insert 108 rests upon the upper edge of annular lower insert 94 and has and inwardly projecting flange 110 for supporting an A-shaped annular upper seal 112 whose inner leg engages piston rod 24 to provide a further fluid seal. Annular center insert 108 also has a peripheral recess for receiving a second upper O-ring 114 which engages the inner surface of insert cap 116 to provide a further fluid seal.

An annular upper insert 118 rests upon the upper edge of annular center insert 108 and has an inner peripheral recess 120 formed by lower flange 122 and upper shorter flange 124 for receiving upper wear ring 126. A hollow insert cap 116 is placed over the inserts, as shown, and is held in place by peripherally spaced bolts 128 which extend through insert cap 116 and into top cap 46. The piston rod assembly 90 just described, provides a substantially fluid-tight seal between piston rod 24 and top cap 46.

A novel piston assembly 130 is shown in FIG. 2. Conveniently, the piston assembly is divided into an annular lower section 132 and a separate annular upper section 134 which facilitates the mounting of annular piston seal 136 therein. In the prior art, it was necessary to stretch a piston seal over the piston and into a peripheral groove formed therein. Because the seal was not very elastic, it was only with great difficulty and much effort that the seal could be gotten into place. With the present invention, prior to assembly of the two annular sections 132 and 134, seal 136 can easily be positioned in groove 138 in lower section 132 and then upper section 134 can be placed on top of lower section 132. Conveniently, the upper facing surface 139 of lower section 132 has a circular depression 140 for receiving a circular boss 142 on the lower facing surface 143 of upper section 134 so that the upper and lower sections are properly aligned. It will be understood that boss 142 and depression 140 could be reversed so that the depression is in upper section 134 and the boss is in lower section 132. Lower section 132 has a peripheral groove 144 for receiving a split lower wear ring 146 for engaging the inner surface of cylinder 36. Similarly, upper section 134 has a peripheral groove 148 for receiving a split upper wear ring 150. Lower section 132 also has a center recess 152 for receiving nut 154 which is threaded on the lower end of piston rod 24 and holds lower section 132 in fixed position with respect to upper section 134. Seal 136, in groove 138, is sandwiched between the upper and lower sections.

During tightening of nut 154, a wrench, not shown, can be positioned at notches 156 near the top of piston rod 24 to hold it from rotating. Recess 152 is sufficiently deep so that nut 154 does not extend below the bottom surface of lower section 132. Piston rod 24 has a reduced lower section 156 which is sized to fit through opening 158 in upper section 134 and forms a shoulder 159 which abuts with the top surface of upper section 134. The length of reduced section 156 is such that the threaded lower end thereof does not extend below the lower surface of lower section 132. When nut 154 is fully tightened, circular boss 142 is fully received within depression 140 so that upper surface 139 is in contact with lower surface 143, as shown.

Advantageously, two or more threaded holes 160 extend through bottom section 132 within recess 152. These threaded holes 160 can be used to assist in disassembly of the piston sections 132 and 134 which may become swaged during assembly. Thus, by inserting bolts in the threaded holes 160 and sequentially tightening them against upper section 134, the sections can be separated.

This invention has been described in detail with reference to particular embodiments thereof, but it will be understood that various other modifications can be effected within the spirit and scope of this invention.

What is claimed is:

1. A piston rod seal assembly for a walking beam compressor cylinder having a top cap, a piston within said cylinder and a piston rod connected to said cylinder and extending through said top cap, said piston rod seal assembly including:

a cylindrical cavity formed in said top cap surrounding said piston rod;

an annular lower insert positioned in said cylindrical cavity;

a lower annular seal and a lower wear ring mounted on said annular lower insert for engagement with said piston rod;

an annular center insert positioned above said annular lower insert;

an upper annular seal mounted on said annular center insert for engagement with said piston rod;

an annular upper insert positioned above said annular center insert and having an upper wear ring for engagement with said piston rod; and a hollow insert cap positioned over said inserts and attached to said top cap.

2. A piston rod seal assembly for a walking beam compressor, as claimed in claim 1, wherein:

said annular lower insert has a first recess for receiving said annular lower wear ring and a second recess for receiving said annular lower seal;

said annular center insert has a third recess for receiving said annular upper seal; and said annular upper insert has a fourth recess for receiving said upper wear ring.

3. A piston rod seal assembly for a walking beam compressor, as claimed in claim 1, wherein:

said upper and lower seals are A-shaped.

* * * * *